US009585540B2

(12) United States Patent
Hodapp, Jr.

(10) Patent No.: US 9,585,540 B2
(45) Date of Patent: Mar. 7, 2017

(54) DISHWASHER APPLIANCE AND A METHOD FOR OPERATING A DISHWASHER APPLIANCE

(71) Applicant: General Electric Company, Schenectady, NY (US)

(72) Inventor: Leo Edward Hodapp, Jr., Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 14/322,050

(22) Filed: Jul. 2, 2014

(65) Prior Publication Data

US 2016/0000297 A1 Jan. 7, 2016

(51) Int. Cl.

| | |
|---|---|
| ***B08B 9/20*** | (2006.01) |
| ***B08B 7/04*** | (2006.01) |
| ***A47L 15/44*** | (2006.01) |
| ***A47L 15/00*** | (2006.01) |

(52) U.S. Cl.

CPC ..... *A47L 15/44* (2013.01); *A47L 15/0049* (2013.01); *A47L 2401/24* (2013.01); *A47L 2401/30* (2013.01); *A47L 2401/32* (2013.01); *A47L 2501/05* (2013.01); *A47L 2501/20* (2013.01)

(58) Field of Classification Search

None

See application file for complete search history.

(56) References Cited

U.S. PATENT DOCUMENTS

| | | | | |
|---|---|---|---|---|
| 7,255,113 | B2 | 8/2007 | Elick et al. | |
| 2003/0140947 | A1* | 7/2003 | Han | A47L 15/4289 134/18 |
| 2010/0139698 | A1* | 6/2010 | Gnadinger | A47L 15/23 134/25.2 |
| 2011/0271984 | A1* | 11/2011 | Ireland | A47L 15/0021 134/18 |
| 2012/0037186 | A1* | 2/2012 | Park | A47L 15/0026 134/18 |

FOREIGN PATENT DOCUMENTS

| | | | |
|---|---|---|---|
| EP | 1929920 | A1 | 6/2008 |
| JP | 2009082392 | A | 4/2009 |

* cited by examiner

*Primary Examiner* — Eric Golightly
*Assistant Examiner* — Arlyn I Rivera-Cordero
(74) *Attorney, Agent, or Firm* — Dority & Manning, P.A.

(57) ABSTRACT

A dishwasher appliance includes a spray detection sensor and a variable speed pump. Based upon signals from the spray detection sensor, a speed of the variable speed pump is changed. By changing the speed of the variable speed pump, a trajectory of wash fluid from a spray assembly of the dishwasher appliance is also changed such that the wash fluid is directed towards a detergent dispenser of the dishwasher appliance. A related method for operating a dishwasher appliance is also provided.

10 Claims, 3 Drawing Sheets

DISHWASHER APPLIANCE AND A METHOD FOR OPERATING A DISHWASHER APPLIANCE

FIELD OF THE INVENTION

The present subject matter relates generally to dishwasher appliances.

BACKGROUND OF THE INVENTION

Dishwasher appliances generally include a tub and spray assemblies for directing wash fluid onto articles within the tub. To assist with cleaning the articles, the wash fluid may include detergent. For example, the detergent may be mixed with water to form the wash fluid. Certain dishwasher appliances include detergent dispensers to provide detergent at suitable times during operation of the dishwasher appliances. A user of the dishwasher appliance may load the detergent dispenser with detergent prior to starting the dishwasher appliance, and the detergent dispenser directs detergent into the wash chamber during operation of the dishwasher appliance in order to form wash fluid within the wash chamber.

Detergent dispensers can have certain shortcomings. For example, detergent may cling to the detergent dispenser and build up over time. Such build up is unsightly and can also negatively affect operation of the detergent dispenser. In addition, detergent comes in various forms, such as liquid, powder, tab or packet. Powder detergent can cake within the detergent dispenser if the detergent dispenser is not properly flushed with fluid. The caked power detergent can hinder subsequent operation of the detergent dispenser. However, removing caked powered detergent from the detergent dispenser can be difficult and inconvenient.

Accordingly, a dishwasher appliance with features for hindering or preventing accumulation of detergent within a detergent dispenser of the dishwasher appliance would be useful. In particular, a dishwasher appliance with features for flushing a detergent dispenser of the dishwasher appliance would be useful.

BRIEF DESCRIPTION OF THE INVENTION

The present subject matter provides a dishwasher appliance. The dishwasher appliance includes a spray detection sensor and a variable speed pump. Based upon signals from the spray detection sensor, a speed of the variable speed pump is changed. By changing the speed of the variable speed pump, a trajectory of wash fluid from a spray assembly of the dishwasher appliance is also changed such that the wash fluid is directed towards a detergent dispenser of the dishwasher appliance. A related method for operating a dishwasher appliance is also provided. Additional aspects and advantages of the invention will be set forth in part in the following description, or may be apparent from the description, or may be learned through practice of the invention.

In a first exemplary embodiment, a method for operating a dishwasher appliance is provided. The method includes operating a variable speed pump of the dishwasher appliance at a first speed. The variable speed pump urges wash fluid to a spray assembly within a wash chamber of the dishwasher appliance during the step of operating. The method also includes receiving a signal from a spray detection sensor of the dishwasher appliance during said step of operating and changing a speed of the variable speed pump from the first speed based at least in part on the signal from the spray detection sensor.

In a second exemplary embodiment, a dishwasher appliance is provided. The dishwasher appliance includes a tub that defines a wash chamber. A door is mounted to the tub in order to provide selective access to the wash chamber of the tub. A detergent dispenser is mounted to the door. A spray detection sensor is positioned adjacent the wash chamber of the tub. A spray assembly is positioned within the wash chamber of the tub. The dishwasher appliance also includes a variable speed pump. A fluid supply conduit extends between the variable speed pump and the spray assembly. The fluid supply conduit directs wash fluid from the variable speed pump to the spray assembly during operation of the variable speed pump. A controller is operatively coupled to the spray detection sensor and the variable speed pump. The controller is configured for operating the variable speed pump at a first speed. The variable speed pump urges wash fluid to the spray assembly during the step of operating. The controller is also configured for receiving a signal from the spray detection sensor during the step of operating and changing a speed of the variable speed pump from the first speed based at least in part on the signal from the spray detection sensor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
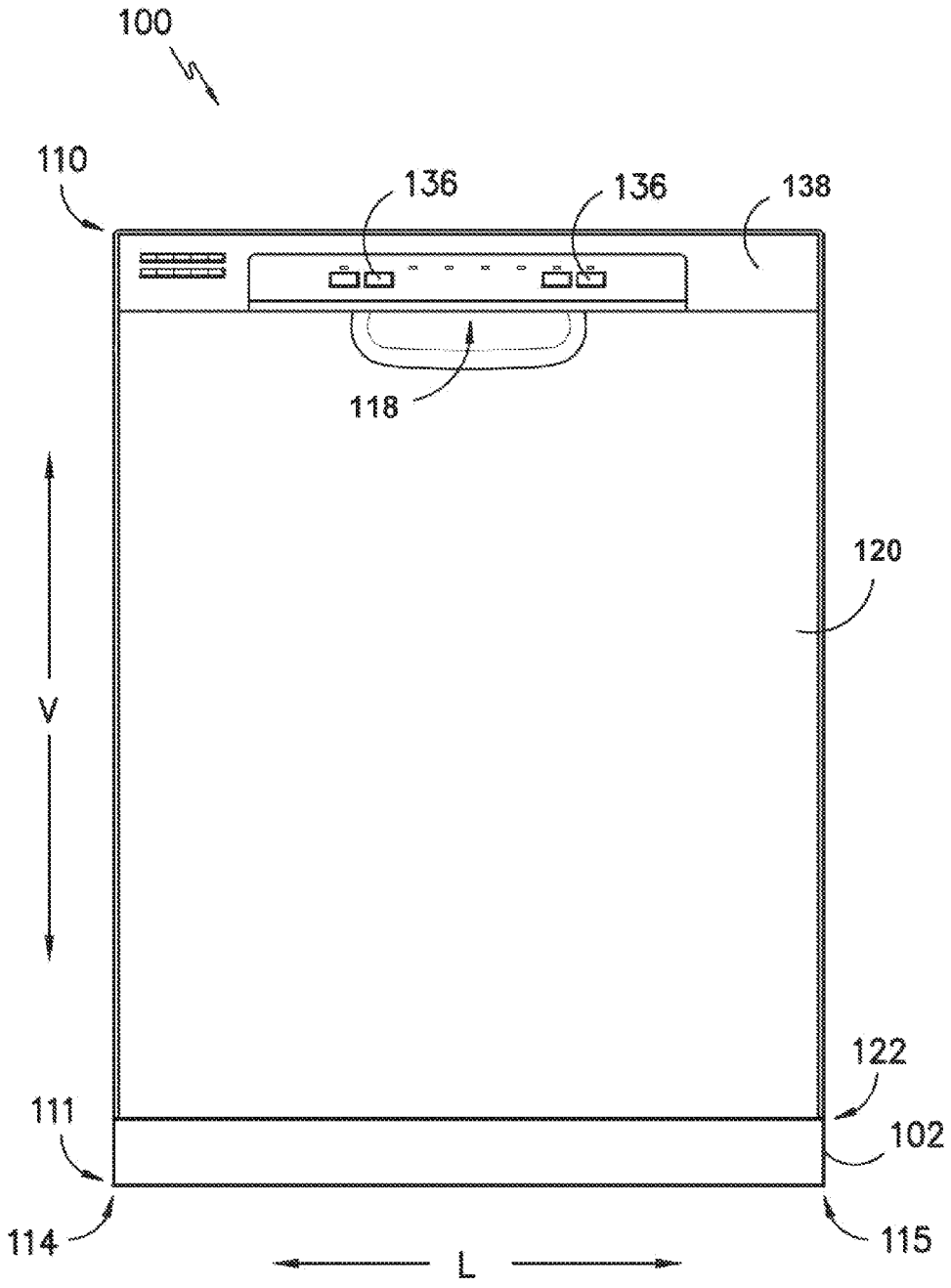
FIG. 1 provides a front, elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
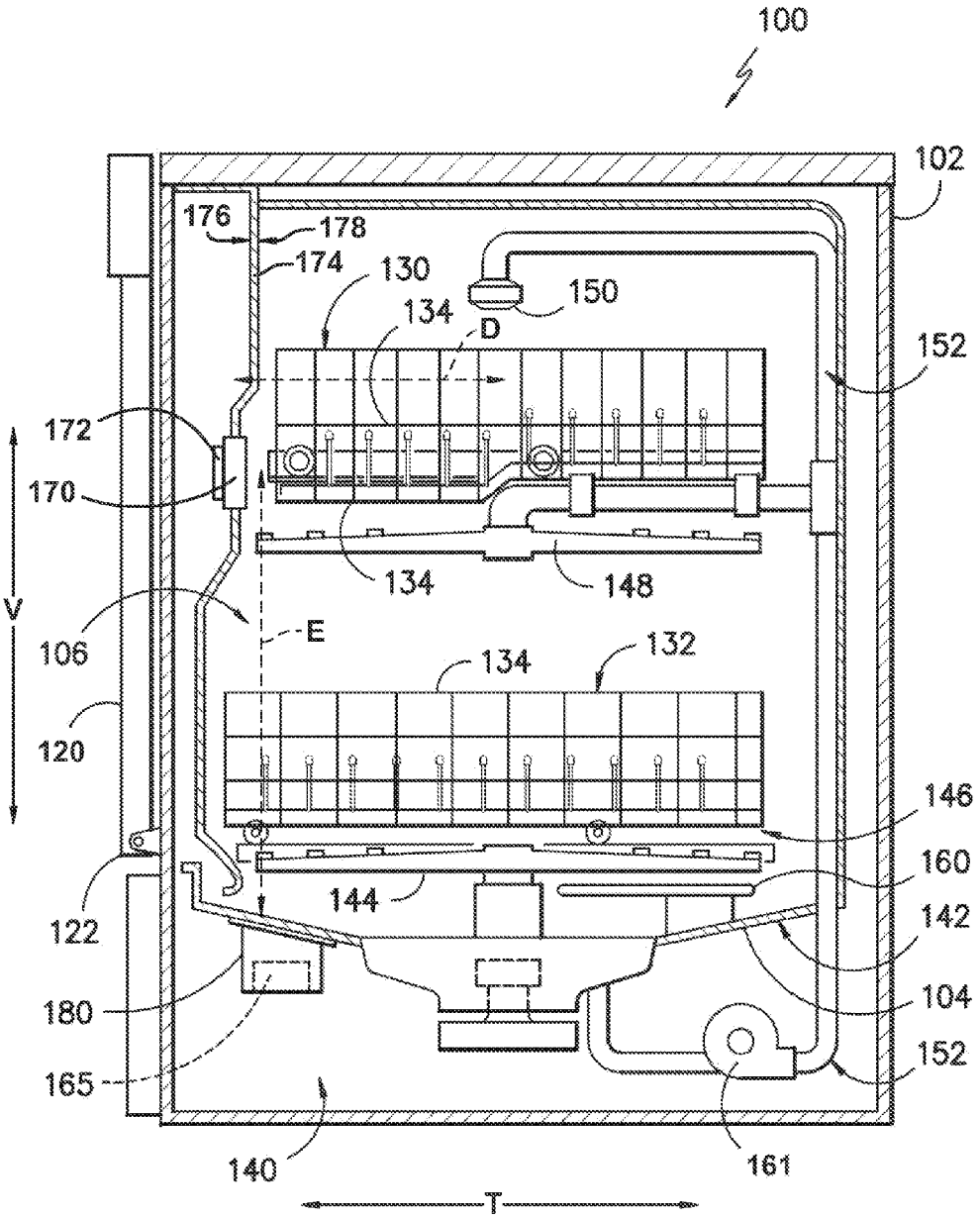
FIG. 2 provides a side, section view of the exemplary dishwasher appliance of FIG. 1.

FIGS. 1 and 2 depict a dishwasher appliance 100 according to an exemplary embodiment of the present subject matter. As may be seen in FIGS. 1 and 2, dishwasher appliance 100 defines a vertical direction V, a lateral direction L and a transverse direction T. The vertical direction L, lateral direction L and transverse direction T are mutually perpendicular and form an orthogonal direction system.

As best shown in FIG. 2, dishwasher appliance 100 includes a cabinet 102 with a tub 104 mounted therein that defines a wash chamber 106. Tub 104 includes a front opening (not shown) and a door 120 hinged at its bottom 122 for movement between a normally closed, vertical position (shown in FIGS. 1 and 2), wherein wash chamber 106 is sealed shut for washing operations, and a horizontal, open position for loading and unloading of articles from dishwasher appliance 100.

Rack assemblies 130 and 132 are slidably mounted within wash chamber 106. Rack assemblies 130 and 132 are configured for receipt of articles for washing, e.g., plates, cups, bowls, or any suitable combination thereof. Each of the rack assemblies 130, 132 is fabricated into lattice structures including a plurality of elongated members 134. Each rack assembly 130, 132 is adapted for movement between an extended loading position (not shown) in which rack assembly is substantially positioned outside wash chamber 106 for facilitating loading of articles therein, and a retracted position (shown in FIGS. 1 and 2) in which the rack is located inside wash chamber 106, e.g., during operation of dishwasher appliance 100.

Dishwasher appliance 100 further includes a lower spray assembly 144 that is (e.g., rotatably) mounted within a lower region 146 of wash chamber 106 above a sump portion 142 of tub 104 so as to be positioned in relatively close proximity to rack assembly 132. A mid-level spray assembly 148 is located in an upper region of wash chamber 106 and is located in close proximity to upper rack assembly 130. Additionally, an upper spray assembly 150 is located above upper rack assembly 130.

Lower and mid-level spray assemblies 144 and 148 and upper spray assembly 150 are fed by a fluid circulation assembly 152 for circulating water and washing liquid (e.g., a solution of detergent, water, and/or rinse aid) within wash chamber 106 of tub 104. Fluid circulation assembly 152 includes a recirculation pump 161 positioned within a machinery compartment 140 located below sump portion 142 of tub 104. Fluid circulation assembly 152 includes piping, conduits or tubing for directing wash fluid from recirculation pump 161 to lower and mid-level spray assemblies 144 and 148 and upper spray assembly 150. Lower and mid-level spray assembly 144 and 148 includes an arrangement of discharge ports or orifices for directing washing liquid onto dishes or other articles located in upper and lower rack assemblies 130 and 132. The arrangement of the discharge ports in lower and mid-level spray assemblies 144 and 148 provides a rotational force by virtue of washing liquid flowing through the discharge ports. The resultant rotation of lower and mid-level spray assemblies 144 and 148 can provide coverage of dishes and other dishwasher contents with a spray of washing liquid.

Dishwasher appliance 100 is also equipped with a heating element 160. Heating element 160 is configured for heating wash liquid and/or water within dishwasher appliance 100. As an example, heating element 160 can function as a booster water heater to increase the temperature of wash liquid within the wash chamber 106, e.g., to a suitable or appropriate temperature for the desired cycle of dishwasher appliance 100. Further, heating element 160 may function to assist drying of articles in upper and lower rack assemblies 130 and 132 during a drying cycle of dishwasher appliance 100. In particular, heating element 160 may be activated to raise the ambient temperature within wash chamber 106 thereby facilitating or expediting drying of articles in upper and lower rack assemblies 130 and 132.

In the exemplary embodiment shown in FIG. 2, heating element 160 is mounted within wash chamber 106, proximate sump portion 142 of tub 104. However, in alternative exemplary embodiments, heating element 160 may be mounted at any suitable location. For example, heating element 160 may be mounted within machinery compartment 140 or within sump portion 142 of tub 104. Heating element 160 may be an electrical resistance heating element or any other suitable mechanism for increasing the temperature of liquid and/or the ambient atmosphere within the wash chamber 106.

Dishwasher appliance 100 is further equipped with a control board or controller 165 to regulate operation of dishwasher appliance 100. The controller 165 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 165 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 165 may be positioned in a variety of locations throughout dishwasher appliance 100. In the illustrated embodiment, controller 165 is located within machinery compartment 140 below tub 104. In particular, controller 165 is mounted within a container or case 180 mounted to tub 104 within machinery compartment 140. Case 180 protects and isolates controller 165 within machinery compartment 140. For example, case 180 is constructed of a metal or other non-flammable material in order to provide for safer operation of dishwasher appliance 100. In particular, by enclosing controller 165 inside a metal case, any failure of the controller 165 will be contained within the case, and potential damage to the dishwasher appliance 100 due to such failure can be mitigated. However, in alternative exemplary embodiments, case 180 may be mounted at any other suitable location within dishwasher appliance 100, e.g., to cabinet 102 or within door 120.

In the embodiment shown in FIG. 2, input/output ("I/O") signals may be routed between controller 165 and various operational components of dishwasher appliance 100 along wiring harnesses as discussed in greater detail below. As an example, controller 165 is in electrical communication with a user input panel 138 (FIG. 1) that includes a plurality of user inputs 136. The plurality of user inputs 136 permits a user to select various operational features and modes and monitor progress of dishwasher appliance 100. In an exemplary embodiment, plurality of user inputs 136 can include a general purpose I/O ("GPIO") device or functional block. In another exemplary embodiment, plurality of user inputs 136 can include one or more of a variety of electrical, mechanical or electro-mechanical input devices including rotary dials, push buttons, and touch pads. User input panel 138 may also include a display component, such as a digital or analog display device designed to provide operational feedback to a user. User input panel 138 may be in communication with controller 165 via one or more signal lines or shared communication busses.

User input panel 138 shown herein is generally referred to a "front-control" control panel. However, as will be understood by those skilled in the art, dishwasher appliance 100 may be provided with other suitable control panels, e.g., "top-control" control panels. Similarly, it should be appreciated that the present subject matter is not limited to any particular style, model, or configuration of dishwasher, and that the embodiment depicted in FIGS. 1 and 2 is for illustrative purposes only. For example, instead of racks 130, 132 depicted in FIG. 1, dishwasher appliance 100 may be of a known configuration that utilizes drawers that pull out from cabinet 102 and are accessible from the top for loading and unloading of articles. Also, dishwasher appliance 100 may not include an external cabinet and may, instead, include a wash chamber or tub mounted to a chassis that is not provided with external cabinetry other than door 120. Other configurations may be used as well.

Recirculation pump 161 may be a variable speed pump and may include a motor and an impeller (not shown), as will be understood by those skilled in the art. The impeller is coupled to the motor such that the impeller rotates and draws wash fluid from tub sump portion 142 to recirculation pump 161 during operation of the motor. Controller 165 is in operative communication with recirculation pump 161, e.g., the motor of recirculation pump 161. For example, controller 165 may be configured for operating the motor of recirculation pump 161 in either of a first operating mode (e.g., a first operating speed) or a second operating mode (e.g., a second operating speed). The motor of recirculation pump 161 may rotate the impeller of recirculation pump 161 at a first average speed in the first operating mode, and motor of recirculation pump 161 may rotate the impeller of recirculation pump 161 at a second average speed in the second operating mode. As an example, controller 165 may utilize pulse-width modulation (PWM) or pulse-duration modulation (PDM) to vary the rotation of the impeller between the first and second average speeds.

When recirculation pump 161 is operating in the first operating mode, the pressure of wash fluid within fluid circulation assembly 152 is such that wash fluid exits lower and mid-level spray assemblies 144 and 148 and upper spray assembly 150 in a first spray pattern. Conversely, the pressure of wash fluid within fluid circulation assembly 152 is such that wash fluid exits lower and mid-level spray assemblies 144 and 148 and upper spray assembly 150 in a second spray pattern when recirculation pump 161 is operating in the second operating mode. Thus, controller 165 may selectively adjust the spray patterns of lower and mid-level spray assemblies 144 and 148 and upper spray assembly 150 by varying the speed of recirculation pump 161.

As may be seen in FIG. 2, dishwasher appliance 100 also includes a detergent cup or dispenser 170 and a spray detection sensor 172. Controller 165 is in operative communication with detergent dispenser 170 and spray detection sensor 172. Detergent dispenser 170 is mounted to door 120, e.g., an interior panel 174 of door 120 that is positioned adjacent or within wash chamber 106 when door 120 is in the closed position. Detergent dispenser 170 is configured for receiving detergent, such as detergent in liquid, powder, tab, or packet form, and storing the detergent therein. The detergent dispenser 170 is also configured for dispensing or evacuating the detergent during operation of dishwasher appliance 100, as will be understood by those skilled in the art. For example, detergent dispenser 170 may include a wax motor that opens a door of detergent dispenser 170 at a suitable time during operation of dishwasher appliance 100 in order to expose the detergent within detergent dispenser 170 to wash fluid within wash chamber 106. It should be understood that detergent dispenser 170 may be mounted to or positioned on any other suitable component of dishwasher appliance 100 in alternative exemplary embodiments. For example, detergent dispenser 170 may be mounted to tub 104 or one of racks 130, 132.

Spray detection sensor 172 is positioned adjacent wash chamber 106 of tub 104. For example, in the exemplary embodiment shown in FIG. 2, interior panel 174 of door 120 has an inner surface 176 and an outer surface 178 positioned opposite each other on interior panel 174. Outer surface 178 of interior panel 174 faces wash chamber 106 of tub 104 when door 120 is in the closed position. Spray detection sensor 172 is positioned at inner surface 176 of interior panel 174 adjacent detergent dispenser 170. In particular, spray detection sensor 172 may be positioned directly behind detergent dispenser 170 within door 120, in certain exemplary embodiments. Thus, spray detection sensor 172 may be positioned within door 120 and shielded from wash chamber 106 and wash fluid therein.

Spray detection sensor 172 may be positioned at any suitable location within dishwasher appliance 100, in alternative exemplary embodiments. For example, spray detection sensor 172 may be mounted to tub 104. In particular, as shown in FIG. 2, detergent dispenser 170 is positioned at an elevation, E, e.g., along the vertical direction V, within wash chamber 106 of tub 104 when door 120 is in the closed position. Detergent dispenser 170 is also positioned at a distance, D, e.g., along at least one of the lateral direction L and the transverse direction T, from a central portion of mid-level spray assembly 148 (or any other suitable spray assembly in alternative exemplary embodiments) when door 120 is in the closed position. Spray detection sensor 172 may be positioned at about the same elevation and/or relative distance from an associated spray assembly as detergent dispenser 170. Thus, spray detection sensor 172 may be positioned on tub 104 such that spray detection sensor 172 is positioned at about the elevation E and spray detection sensor 172 is also positioned at about the distance D from mid-level spray assembly 148. For example, spray detection sensor 172 may be positioned at a height that is within about ten percent of the elevation E, and spray detection sensor 172 may be positioned at a location that is within about ten percent of the distance D from mid-level spray assembly 148.

Spray detection sensor 172 is configured for detecting an intensity or concentration of wash fluid striking spray detection sensor 172 or a portion of dishwasher appliance 100 adjacent spray detection sensor 172, such as tub 104 or door 120. By placing spray detection sensor 172 adjacent detergent dispenser 170 or at common position relative to at least one of lower and mid-level spray assemblies 144 and 148 and upper spray assembly 150, spray detection sensor 172 may be used to measure or detect an intensity or concentration of wash fluid striking detergent dispenser 170, as discussed in greater detail below.

Spray detection sensor 172 may be any suitable type of sensor. For example, spray detection sensor 172 may be a piezoelectric sensor, an accelerometer, an acoustic-to-electric transducer, an optical sensor or suitable combinations thereof. When spray detection sensor 172 is a piezoelectric sensor, spray detection sensor 172 may measure the intensity or concentration of wash fluid by measuring the voltage from spray detection sensor 172, e.g., with a higher voltage corresponding to a higher wash fluid intensity or concentration, or a frequency of the voltage from spray detection sensor 172, e.g., with a higher frequency oscillation of the voltage corresponding to a higher wash fluid intensity or concentration. When spray detection sensor 172 is an accelerometer, spray detection sensor 172 may measure the intensity or concentration of wash fluid with acceleration measurements from spray detection sensor 172, e.g., with a higher acceleration measurements corresponding to a higher wash fluid intensity or concentration. Similar methods may be used with alternative spray detection sensors.

Figure 3:
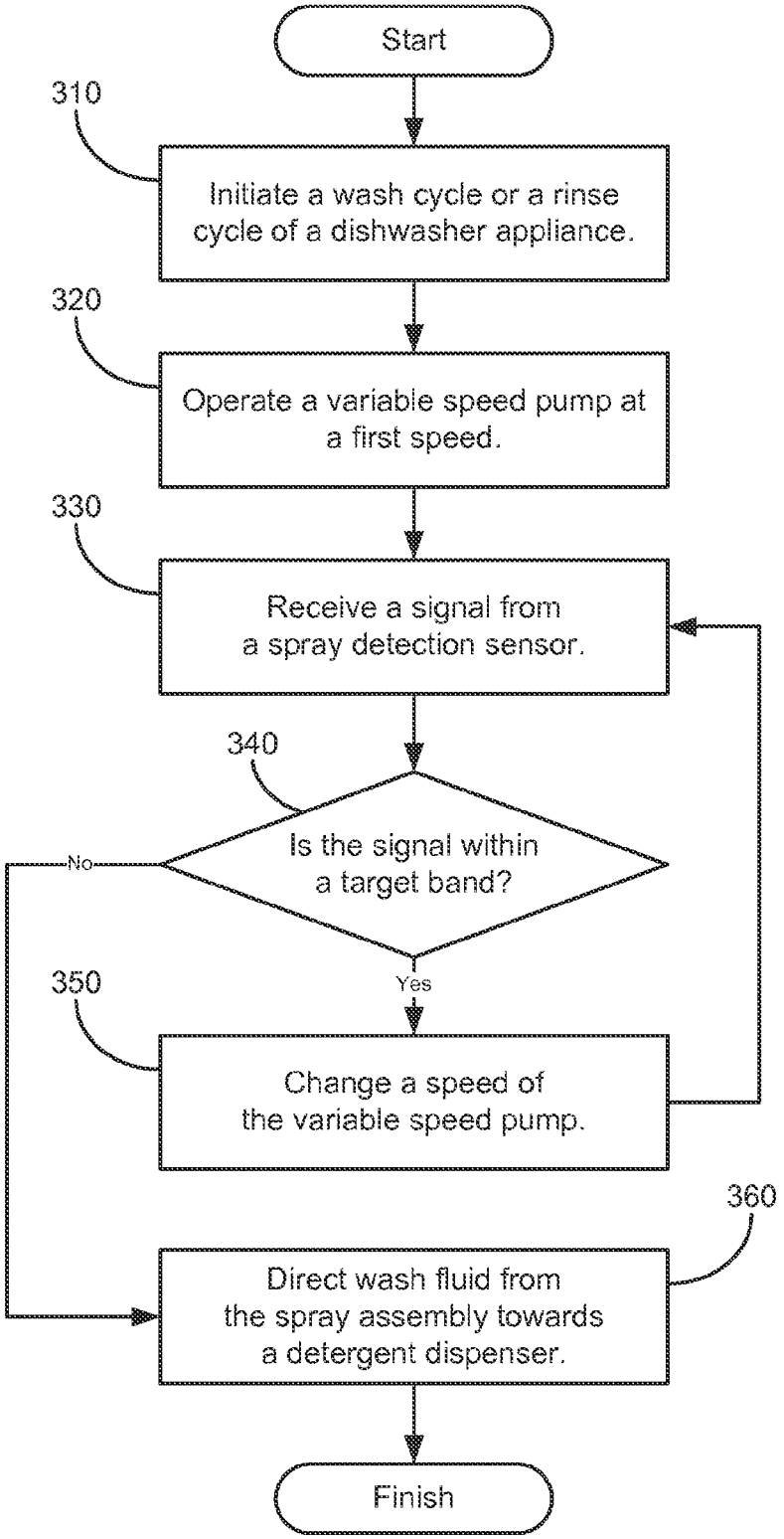
FIG. 3 illustrates a method for operating a dishwasher appliance according to an exemplary embodiment of the present subject matter.

FIG. 3 illustrates a method 300 for operating a dishwasher appliance according to an exemplary embodiment of the present subject matter. Method 300 may be used to operate any suitable dishwasher appliance. For example, method 300 may be used to operate dishwasher appliance 100 (FIG. 2). Controller 165 may be configured or programmed to implement method 300. Utilizing method 300, detergent dispenser 170 of dishwasher appliance 100 may be flushed or rinsed in order to remove (e.g., excess) detergent from detergent dispenser 170.

At step 310, a wash cycle or a rinse cycle of dishwasher appliance 100 is initiated. For example, a user of dishwasher appliance 100 may utilize user input panel 138 and inputs 136 to signal controller 165 in order to initiate the wash or rinse cycle at step 310. During the wash or rinse cycle, controller 165 may operate recirculation pump 161 in order to direct wash fluid onto articles within racks 130, 132 via lower and mid-level spray assemblies 144 and 148 and/or upper spray assembly 150.

At step 320, controller 165 operates recirculation pump 161 at a first speed. Thus, at step 320, variable speed pump 320 urges wash fluid to at least one of lower and mid-level spray assemblies 144 and 148 and upper spray assembly 150. Due to recirculation pump 161 operating at a first speed, wash fluid may exit lower and mid-level spray assemblies 144 and 148 and upper spray assembly 150 at a first trajectory at step 320.

At step 330, controller 165 receives a signal (e.g., a voltage or current) from spray detection sensor 172. A magnitude of the signal may correspond to a strength or proximity of wash fluid striking an area adjacent spray detection sensor 172. Controller 165 may change a speed of recirculation pump 161 from the first speed based at least in part on the signal from spray detection sensor 172. In particular, controller 165 may increase or decrease the speed of recirculation pump 161 in order to increase the signal from spray detection sensor 172. When the speed of recirculation pump 161 is changed from the first speed, wash fluid may exit lower and mid-level spray assemblies 144 and 148 and upper spray assembly 150 at a second trajectory, with the second trajectory being different than the first trajectory.

At step 340, controller 165 determines whether the signal from spray detection sensor 172 is within a target band or range. If the signal from spray detection sensor 172 is not within the target band at step 340, controller 165 changes (e.g., increases or decreases) the speed of recirculation pump 161 at step 350 and continues to monitor the signal from spray detection sensor 172. Thus, controller 165 may receive an additional signal from spray detection sensor 172 after changing the speed of recirculation pump 161 at step 350. Conversely, controller 165 maintains the speed of recirculation pump 161 and directs wash fluid from at least one of lower and mid-level spray assemblies 144 and 148 and upper spray assembly 150 towards detergent dispenser 170 at step 360 if the signal from spray detection sensor 172 is within the target band at step 350. Thus, at steps 330, 340 and 350, controller 165 may increase or decrease the speed of recirculation pump 161 in order to maximize the signal from spray detection sensor 172.

As discussed above, the trajectory of wash fluid emitted by lower and mid-level spray assemblies 144 and 148 and upper spray assembly 150 changes when the speed of recirculation pump 161 is adjusted. Thus, at steps 330, 340 and 350, controller 165 may adjust the speed of recirculation pump 161 in order to vary the trajectory of the wash fluid streams from lower and mid-level spray assemblies 144 and 148 and upper spray assembly 150 and target detergent dispenser 170. Thus, utilizing feedback from spray detection sensor 172, wash fluid from at least one of lower and mid-level spray assemblies 144 and 148 and upper spray assembly 150 may flush or rinse detergent dispenser 170 during the wash cycle or rinse cycle and thereby remove excess detergent from detergent dispenser 170. In particular, when the signal from spray detection sensor 172 is within the target band, method 300 may determine or establish that wash fluid from at least one of lower and mid-level spray assemblies 144 and 148 and upper spray assembly 150 is flushing or rinsing detergent dispenser 170.

Utilizing method 300, the speed of recirculation pump 161 is adjusted in order to flush or rinse detergent dispenser 170. For example, a volume of wash fluid impacting detergent dispenser 170 immediately before step 360 may be greater than the volume of wash fluid impacting detergent dispenser 170 at step 360. By flushing or rinsing detergent dispenser 170, a performance of dishwasher appliance 100 and user satisfaction with dishwasher appliance 100 may be improved.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a dishwasher appliance comprising a detergent dispenser, the method comprising:

operating a variable speed pump of the dishwasher appliance at a first speed, the variable speed pump urging wash fluid to a spray assembly within a wash chamber of the dishwasher appliance during said step of operating;

receiving a signal from a spray detecting sensor of the dishwasher appliance during said step of operating, the signal indicating an intensity or concentration of wash fluid striking the detergent dispenser; and changing a speed of the variable speed pump from the first speed based at least in part on the signal from the spray detection sensor.

2. The method of claim 1, wherein a trajectory of wash fluid emitted by the spray assembly varies during said changing.

3. The method of claim 1, wherein the spray detection sensor comprises at least one of a piezoelectric sensor, an accelerometer, an acoustic-to-electric transducer or an optical sensor.

4. The method of claim 1, further comprising directing wash fluid from the spray assembly towards the detergent dispenser after said step of changing.

5. The method of claim 4, wherein a volume of wash fluid impacting the detergent dispenser immediately after said step of changing is greater than a volume of wash fluid impacting the detergent dispenser immediately before said step of changing.

6. The method of claim 1, further comprising receiving an additional signal from the spray detection sensor of the dishwasher appliance after said step of changing.

7. The method of claim 6, wherein said step of changing comprises increasing or decreasing the speed of the variable speed pump in order to increase the additional signal.

8. The method of claim 1, wherein the detergent dispenser of the dishwasher appliance is positioned at an elevation (E) within the wash chamber and at a distance (D) from the spray assembly, the spray detection sensor positioned at about the elevation (E) and at about the distance (D) from the spray assembly.

9. The method of claim 8, wherein the detergent dispenser and the spray detection sensor are mounted to a door of the dishwasher appliance.

10. The method of claim 8, wherein the detergent dispenser is mounted to a door of the dishwasher appliance, the spray detection sensor mounted to a tub of the dishwasher appliance.

* * * * *